US012577951B2

(12) United States Patent
Haseley et al.

(10) Patent No.: US 12,577,951 B2
(45) Date of Patent: Mar. 17, 2026

(54) ELECTRIC COMPRESSOR WITH SCROLL BACKPRESSURE SYSTEM

(71) Applicant: MAHLE INTERNATIONAL GMBH, Stuttgart (DE)

(72) Inventors: Brent Haseley, Niagara Falls, NY (US); Collin Reformat, Depew, NY (US); Corey Van Auken, Buffalo, NY (US); James Rogers, Cheektowaga, NY (US)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 18/609,310

(22) Filed: Mar. 19, 2024

(65) Prior Publication Data

US 2025/0297607 A1 Sep. 25, 2025

(51) Int. Cl.
*F04C 18/02* (2006.01)

(52) U.S. Cl.
CPC ..... *F04C 18/0215* (2013.01); *F04C 2240/30* (2013.01); *F04C 2240/403* (2013.01)

(58) Field of Classification Search
CPC .. F04C 18/0215; F04C 18/02; F04C 18/0207; F04C 18/0223; F04C 23/008; F04C 29/128; F04C 2240/30; F04C 2240/403; F04C 2240/808; F04C 2240/40
See application file for complete search history.

(56) References Cited

U.S. PATENT DOCUMENTS

| | | | | |
|---|---|---|---|---|
| 6,872,063 | B2 | 3/2005 | Kimura et al. | |
| 8,202,071 | B2 * | 6/2012 | Kii | F04C 29/023 418/55.6 |
| 8,998,595 | B2 | 4/2015 | Ito et al. | |
| 9,360,012 | B2 | 6/2016 | Yamashita et al. | |
| 9,885,347 | B2 * | 2/2018 | Lachey | F04B 39/0022 |
| 10,094,379 | B2 | 10/2018 | Won et al. | |
| 11,326,600 | B2 | 5/2022 | Hattori et al. | |
| 2004/0136855 | A1 * | 7/2004 | Kimura | F04C 27/005 418/57 |
| 2009/0285708 | A1 * | 11/2009 | Yokoi | F04C 29/026 418/55.6 |
| 2011/0243777 | A1 | 10/2011 | Ito et al. | |

(Continued)

OTHER PUBLICATIONS

Extended European Search Report for corresponding EP Patent Application No. 25160991.3, issued on Jun. 23, 2025, 12 pages.

*Primary Examiner* — Dapinder Singh
(74) *Attorney, Agent, or Firm* — Endurance Law Group PLC; James R. Yee

(57) ABSTRACT

An electric compressor includes a housing, refrigerant inlet port, a refrigerant outlet port, an inverter section, a motor section, a compression device and a front cover. The housing defines an intake volume and a discharge volume. The refrigerant inlet port is coupled to the housing and is configured to introduce the refrigerant to the intake volume. The compression device is a scroll-type compression device configured to compress the refrigerant. The refrigerant outlet port is coupled to the housing and is configured to allow compressed refrigerant to exit the scroll-type electric compressor from the discharge volume. The electric compressor including a scroll backpressure system, located at least partially, within a compression device body.

24 Claims, 7 Drawing Sheets

(56) References Cited

U.S. PATENT DOCUMENTS

| | | | | |
|---|---|---|---|---|
| 2013/0189143 | A1* | 7/2013 | Yamashita | F04C 18/0215 251/321 |
| 2014/0248172 | A1 | 9/2014 | Nagano et al. | |
| 2019/0211828 | A1 | 7/2019 | Teshima et al. | |
| 2019/0293071 | A1 | 9/2019 | Sato | |
| 2020/0032795 | A1* | 1/2020 | Kim | F04C 23/008 |

* cited by examiner

FIG. 7A
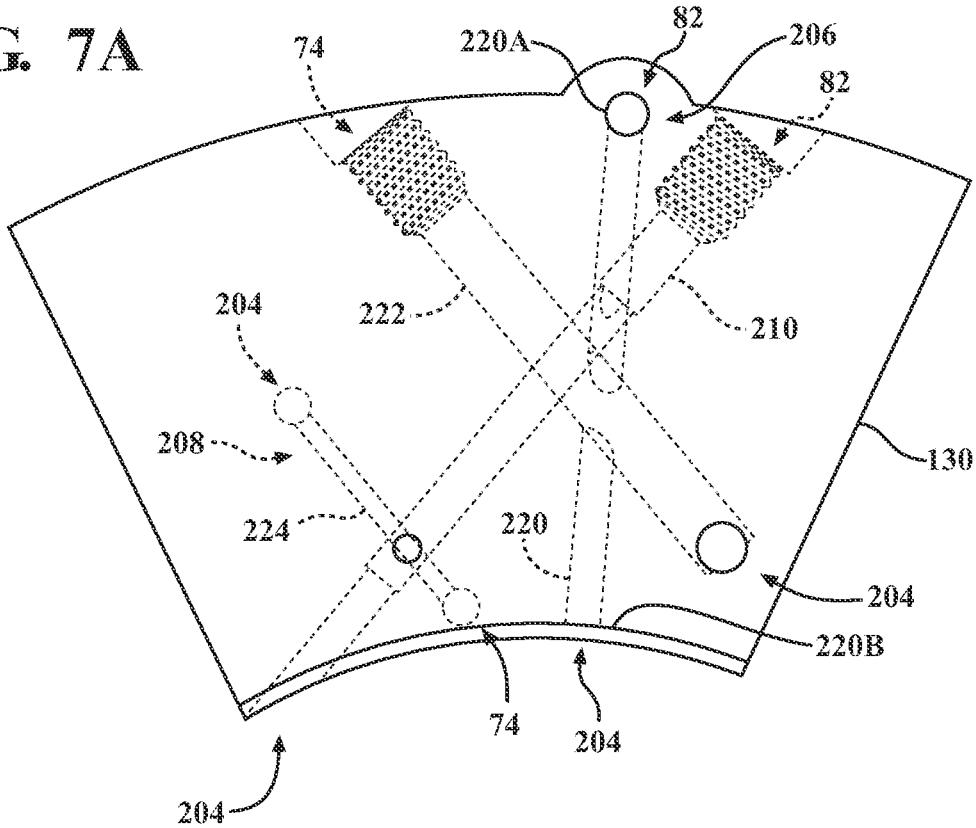
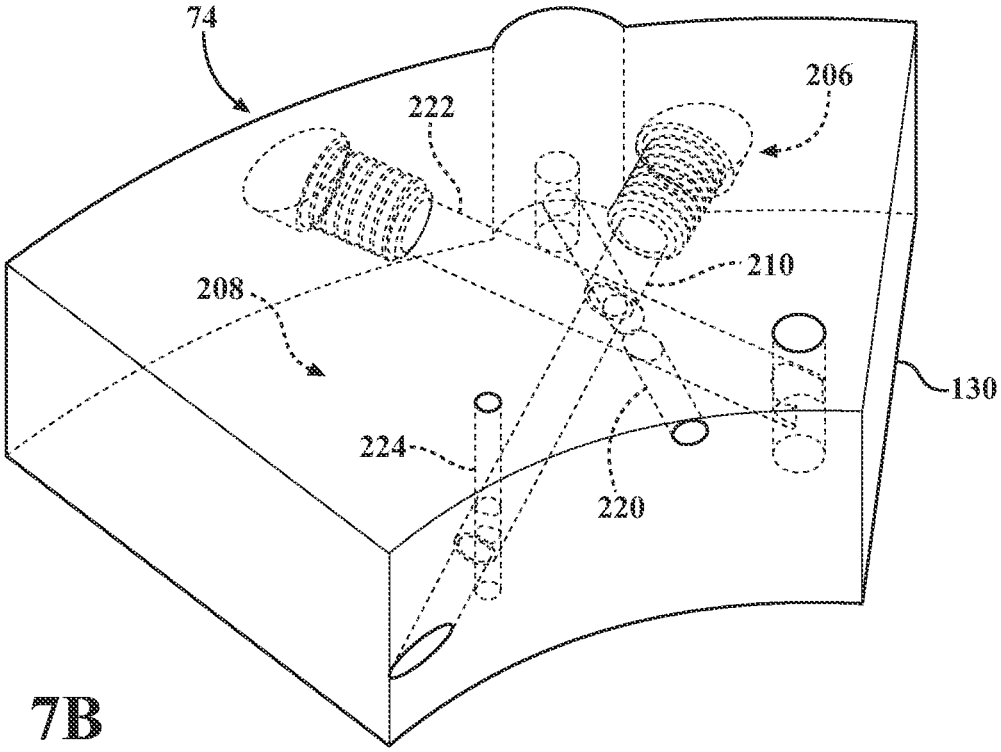
FIG. 7B

ELECTRIC COMPRESSOR WITH SCROLL BACKPRESSURE SYSTEM

FIELD OF THE INVENTION

The invention relates generally to electric compressor, and more particularly to an electric compressor that compresses a refrigerant using a scroll compression device.

BACKGROUND OF THE INVENTION

Compressors have long been used in cooling systems. In particular, scroll-type compressors, in which an orbiting scroll is rotated in a circular motion relative to a fixed scroll to compress a refrigerant, have been used in systems designed to provide cooling in specific areas. For example, such scroll-type compressors have long been used in the HVAC systems of motor vehicles, such as automobiles, to provide air-conditioning. Such compressors may also be used, in reverse, in applications requiring a heat pump. Generally, these compressors are driven using rotary motion derived from the automobile's engine.

With the advent of battery-powered or electric vehicles and/or hybrid vehicles, in which the vehicle may be solely powered by a battery at times, such compressors must be driven or powered by the battery rather than an engine. Such compressors may be referred to as electric compressors.

In addition to cooling a passenger compart of the motor vehicle, electric compressors may be used to provide heating or cooling to other areas or components of the motor vehicle. For instance, it may be desired to heat or cool the electronic systems and the battery or battery compartment, when the battery is being charged, especially during fast charging modes, as such generate heat which may damage or degrade. the battery and/or other system. It may also be used to cooling the battery during times when the battery is not being charged or used, as heat may damage or degrade the battery. Since the electric compressor may be run at various times, even when the motor vehicle is not in operation, such use, obviously, requires electrical energy from the battery, thus reducing the operating time of the battery.

Scroll compressors typically include an intake volume in which refrigerant is received (from an external source) and a discharge volume which is located downstream of the fixed and orbiting scrolls and contains or collected compressed refrigerant. Within the compressor, a backpressure may be used to load the orbiting scroll against the fixed scroll. With proper loading of the orbiting scroll against the fixed scroll, proper operation may ensure while allowing for thermal expansion, manufacturing tolerances, etc., Further, proper loading may also assist with providing proper sealing between the scrolls.

The backpressure must be large enough to overcome axial separation of the scrolls. However, if the backpressure is too large, may result in loss of oil film between the scrolls, excess friction and, reduced efficiency.

Additionally, electric compressors may run at a very high speed, e.g., 2,000 RPM (or higher). Such high speed may generate unwanted levels of noise.

It is thus desirable, to provide an electric compressor having high efficiency, low-noise and maximum operating life. The present invention is aimed at one or more of the problems or advantages identified above.

BRIEF SUMMARY OF THE INVENTION

In a one aspect of the present invention, an electric scroll compressor configured to compress a refrigerant is provided.

The electric scroll compressor including a housing, a refrigerant inlet port, a refrigerant outport port, an inverter module, a motor, a drive shaft, a compression device, and a scroll backpressure system. The housing defines an intake volume and a discharge volume. The refrigerant inlet port is coupled to the housing and is configured to introduce the refrigerant to the intake volume. The refrigerant outlet port is coupled to the housing and is configured to allow compressed refrigerant to exit the electric scroll compressor from the discharge volume. The inverter module is mounted inside the housing and is adapted to convert direct current electrical power to alternating current electrical power. The motor is mounted inside the housing. The drive shaft is coupled to the motor. The compression device is coupled to the drive shaft for receiving the refrigerant from the intake volume and compressing the refrigerant as the drive shaft is rotated by the motor.

The compression device includes a compression device body, a fixed scroll, and an orbiting scroll. The fixed scroll is located within the housing and is fixed relative to the compression device body. The orbiting scroll is coupled to the drive shaft. The orbiting scroll and the fixed scroll form compression chambers for receiving the refrigerant from the intake volume and compressing the refrigerant as the drive shaft is rotated about the center axis. The compression device forms a backpressure pocket.

The scroll backpressure system is located at least partially, within the compression device body, and includes a first pressure pathway and second pressure pathway. The first pressure pathway is located between the discharge volume and the backpressure pocket and is configured to allow pressurized refrigerant in the discharge volume to be introduced into the backpressure pocket. The first pressure pathway is formed, at least partially, in the compression device body. The second pressure pathway is located between the backpressure pocket and the intake volume and includes a dump valve for controllably bleeding off pressured refrigerant in the backpressure pocket into the intake volume.

In a first embodiment of the present invention, an electric scroll compressor configured to compress a refrigerant provided. The electric scroll compressor includes a housing, a refrigerant inlet port, a refrigerant outlet port, an inverter module, a motor, a drive shaft, a compression device and a scroll backpressure system. The housing includes a center housing and a front cover and defines an intake volume and a discharge volume. The discharge volume is formed, at least partially, by the center housing the front cover. The refrigerant inlet port is coupled to the housing and is configured to introduce the refrigerant to the intake volume. The refrigerant outlet port is coupled to the housing and is configured to allow compressed refrigerant to exit the electric scroll compressor from the discharge volume. The inverter module is mounted inside the housing and adapted to convert direct current electrical power to alternating current electrical power. The motor is motor mounted inside the housing and the drive shaft is coupled to the motor.

The compression device is coupled to the drive shaft for receiving the refrigerant from the intake volume and compressing the refrigerant as the drive shaft is rotated by the motor. The compression device includes a compression device body, a fixed scroll and an orbiting scroll. The compression device body includes a thrust body. The backpressure pocket is formed at least partially by the thrust body. The fixed scroll is located within the housing and is fixed relative to the compression device body. The orbiting scroll is coupled to the drive shaft. The orbiting scroll and the fixed scroll form compression chambers for receiving the refrigerant from the intake volume and compressing the refrigerant as the drive shaft is rotated about the center axis. The compression device forming a backpressure pocket.

The scroll backpressure system is located at least partially, within the compression device body and includes a first pressure pathway and a second pressure pathway.

The first pressure pathway is between the discharge volume and the backpressure pocket and is configured to allow pressurized refrigerant in the discharge volume to be introduced into the backpressure pocket. The first pressure pathway is formed, at least partially, in the compression device body.

The compression device body includes a thrust plate. The backpressure pocket is formed at least partially by the thrust plate. The first pressure pathway is formed through the front cover, the center housing and the thrust body. The first pressure pathway has a first pressure pathway end connected to the refrigerant outlet port and a second pressure pathway end connected to the backpressure pocket. The first pressure pathway includes a fixed orifice to restrict flow of the pressurized refrigerant from the discharge volume to the backpressure pocket.

The second pressure pathway is located between the backpressure pocket and the intake volume and includes a dump valve for controllably bleeding off pressured refrigerant in the backpressure pocket into the intake volume. The dump valve is configured to maintain a fixed pressure differential between the backpressure pocket and the intake volume and is located, at least partially, within the thrust body.

In a second embodiment of the present invention, an electric scroll compressor configured to compress a refrigerant is provided. The electric scroll compressor includes a housing, a refrigerant inlet port, a refrigerant outlet port, an inverter section, a motor section, a compression device, and a scroll backpressure system.

The housing defines an intake volume and a discharge volume. The refrigerant inlet port is coupled to the housing and is configured to introduce the refrigerant to the intake volume. The refrigerant outlet port is coupled to the housing and is configured to allow compressed refrigerant to exit the electric scroll compressor from the discharge volume.

The inverter section includes an inverter housing, an inverter back cover, and an inverter module. The inverter back cover is connected to the inverter housing and forms an inverter cavity. The inverter module is mounted inside the inverter cavity and is adapted to convert direct current electrical power to alternating current electrical power.

The motor section includes a drive shaft and a motor. The drive shaft is located within the housing, has first and second ends and defines a center axis. The motor is located within the housing to controllably rotate the drive shaft about the center axis. The compression device is coupled to the drive shaft for receiving the refrigerant from the intake volume and compressing the refrigerant as the drive shaft is rotated by the motor.

The compression device includes a compression device body, a fixed scroll and an orbiting scroll. The compression device body includes a thrust body. The backpressure pocket is formed at least partially by the thrust body. The fixed scroll is located within the housing and is fixed relative to the thrust body. The orbiting scroll is coupled to the drive shaft. The orbiting scroll and the fixed scroll form compression chambers for receiving the refrigerant from the intake volume and compressing the refrigerant as the drive shaft is rotated about the center axis.

The scroll backpressure system is located at least partially, within the compression device body and includes a first pressure pathway, a second pressure pathway, and a back pressure regulator valve. The first pressure pathway is located between the discharge volume and the backpressure pocket and is configured to allow pressurized refrigerant in the discharge volume to be introduced into the backpressure pocket. The first pressure pathway is formed, at least partially, in the thrust body. The second pressure pathway is located between the backpressure pocket and the intake volume and the second pressure pathway including a dump valve for controllably bleeding off pressured refrigerant in the backpressure pocket into the intake volume.

The back pressure regulator valve is connected between the intake volume and the backpressure pocket and is located at least partially within the thrust body. The back pressure regulator valve is configured to modify flow of pressure refrigerant from the discharge volume to the backpressure pocket through the first pressure pathway as a function of pressure differential between the intake volume and the backpressure pocket.

The second pressure pathway includes a passage and the dump valve. The passage is located within the compression device body between the intake volume and the backpressure pocket. The dump valve is coupled between the discharge volume and the backpressure pocket to control the flow of refrigerant between the backpressure pocket and the intake volume as a function of pressure differential between the discharge volume and the backpressure pocket.

BRIEF DESCRIPTION OF THE SEVERAL VIEWS OF THE DRAWINGS

These and other features and advantages of the present invention will become more readily appreciated when considered in connection with the following detailed description and appended drawings.

FIGS. 7A-7B are graphic depictions of a portion of an electric compressor including the scroll backpressure system of FIGS. 3A-3B, according to the second embodiment.

DETAILED DESCRIPTION OF THE INVENTION

Figure 1:
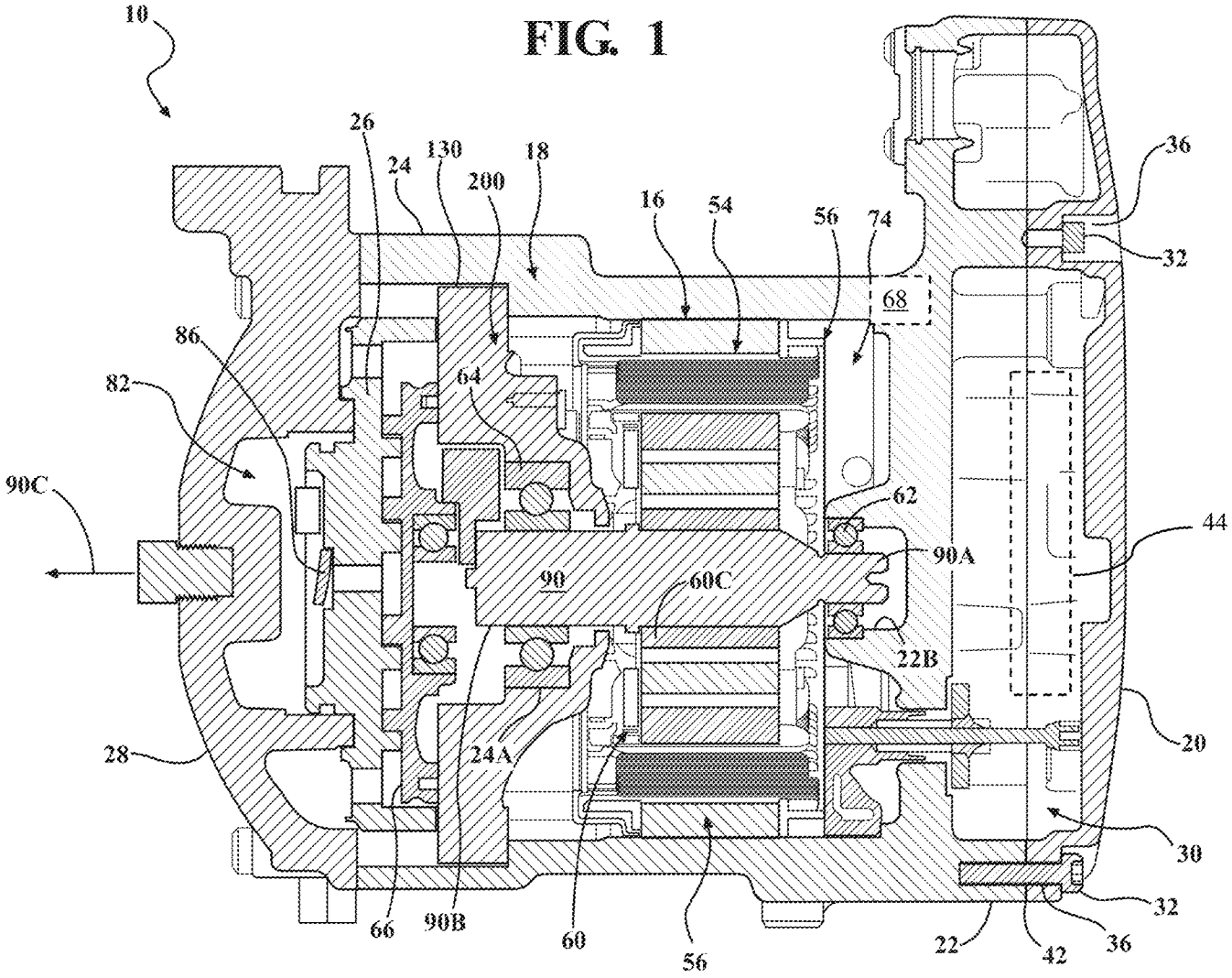
FIG. 1 is a cross-sectional view of an electric compressor according to an embodiment of the present invention.

Referring to the FIGS. 1-2, 3A-3B, 4A-4D, 5A-5B, 6 and 7A-7B, wherein like numerals indicate like or corresponding parts throughout the several views, an electric compressor 10 having an outer housing 12 is provided. The electric compressor 10 is particularly suitable in a motor vehicle, such as an automotive vehicle (not shown). The electric compressor 10 may be used as a cooling device or as a heating pump to heat and/or cool different aspects of the vehicle. For instance, the electric compressor 10 may be used as part of the heating, ventilation and air conditioning (HVAC) system in electric vehicles (not shown) to cool or heat a passenger compartment. In addition, the electric compressor 10 may be used to heat or cool the passenger compartment, on-board electronics and/or a battery used for powering the vehicle while the vehicle is not being operated, for instance, during a charging cycle. The electric compressor 10 may further be used while the vehicle is not being operated and while the battery is not being charged to maintain, or minimize the degradation, of the life of the battery.

In the illustrated embodiment, the electric compressor 10 is a scroll-type compressor acts to compress a refrigerant rapidly and efficiently for use in different systems of a motor vehicle, for example, an electric or a hybrid vehicle. The electric compressor 10 includes an inverter section 14, a motor section 16, and a compression device (or compression assembly) 18 contained within the outer housing 12. The outer housing 12 includes an inverter back cover 20, an inverter housing 22 and a center housing 24 (which may be integral), a front cover 28 (which may be referred to as the discharge head). The center housing 24 houses the motor section 16 and the compression device 28.

In one embodiment, the inverter back cover 20, the inverter housing 22, the center housing 24, and the front cover 28 are composed from machined aluminum. The inverter 10 may be mounted, for example, within the body of a motor vehicle, via a plurality of mount points (not shown). In one aspect of the electric compressor 10 of the disclosure, an electric compressor 10 having a scroll back-pressure system 200 (see below) is provided.

General Arrangement, and Operation, of the Electric Compressor 10

The inverter back cover 20 and the inverter housing 22 form an inverter cavity 30. The inverter back cover 20 is mounted to the inverter housing 22 by a plurality of bolts 32. An inverter gasket 42, positioned between the inverter back cover 20 and the inverter housing 22 keeps moisture, dust, and other contaminants from the inverter cavity 30.

An inverter module (not shown) mounted within the inverter cavity 30 formed by the inverter back cover 20 and the inverter housing 22. The inverter module may include an inverter circuit (not shown) mounted on a printed circuit board (not shown), which is mounted to the inverter housing 22. The inverter circuit converts direct current (DC) electrical power received from outside of the electric compressor 10 into three-phase alternating current (AC) power to supply/power a motor 54 (see below). The inverter circuit may also control the rotational speed of the electric compressor 10. High voltage DC current is supplied to the inverter circuit via a high voltage connector (not shown). Low voltage DC current to drive the inverter circuit, as well as control signals to control operation of the inverter circuit, and the motor section 16, may be supplied via a low voltage connecter (not shown).

The center housing 24 forms a motor cavity 56. The motor section 16 includes a motor 54 located within the motor cavity 56. With specific reference to FIG. 12, in the illustrated embodiment, the motor 54 is a three-phase AC motor having a stator 58. The stator 58 has a generally hollow cylindrical shape with six individual coils (two for each phase). The stator 58 is contained within, and mounted to, the motor housing 22 and remains stationery relative to the motor housing 22.

The motor 54 includes a rotor 60 located within, and centered relative to, the stator 58. The rotor 60 has a generally hollow cylindrical shape and is located within the stator 58.

A drive shaft 90 is coupled to the rotor 60 and rotates therewith. In the illustrated embodiment, the draft shaft 90 is press-fit within a center aperture 60C of the rotor 60. The drive shaft 90 has a first end 90A and a second end 90B. The inverter housing 22 includes a first drive shaft supporting member 22B located on the motor side of the inverter housing 22. A first ball bearing 62 located within an aperture formed by the first drive shaft supporting member 22 supports and allows the first end of the drive shaft 90 to rotate. The center housing 24 includes a second drive shaft supporting member 24A. A second ball bearing 64 located within an aperture formed by the second drive shaft supporting member 24A allows the second end 90B of the drive shaft 90 to rotate. In the illustrated embodiment, the first and second ball bearing 62, 64 are press-fit with the apertures formed by the first drive shaft supporting member 22 of the inverter housing 22 and the second drive shaft supporting member 24A of the center housing 24, respectively.

As stated above, the electric compressor 10 is a scroll-type compressor. The compression device 18 includes the fixed scroll 26 and an orbiting scroll 66. The orbiting scroll 66 is fixed to the second end of the rotor 60B. The rotor 60 with the drive shaft 90 rotate to drive the orbiting scroll 66 motion under control of the inverter module 44.

The drive shaft 90 has a central axis 90C around which the rotor 60 and the drive shaft 90 are rotated. The orbiting scroll 66 moves about the central axis 90C in an eccentric orbit, i.e., in a circular motion while the orientation of the orbiting scroll 66 remains constant with respect to the fixed scroll 26. The center of the orbiting scroll 66 is located along an offset axis (not shown) of the drive shaft 90.

Generally, intermixed refrigerant and oil (at low pressure) enters the electric compressor 10 via a refrigerant inlet port 68 and exits the electric compressor 10 (at high pressure) via refrigerant outlet port 70 after being compressed by the compression device 18. Refrigerant follows a refrigerant path through the electric compressor 10. Refrigerant enters the refrigerant inlet port 68 and enters an intake volume 74 formed between the motor side of the inverter housing 22 and the center housing 24 adjacent the refrigerant inlet port 68. Refrigerant is then drawn through the motor section 16 and enters a compression intake volume formed between an internal wall of the fixed scroll 26 and the orbiting scroll 66.

The fixed scroll 26 is mounted within the center housing 24. Refrigerant enters the compression device 12 from the compression intake volume. The fixed scroll 26 and the orbiting scroll 66 form compression chambers 80 in which low or unpressurized (saturation pressure) refrigerant enters from the compression device 12. As the orbiting scroll 66 moves to enable the compression chambers 80 to be closed off and the volume of the compression chambers is reduced to pressurize the refrigerant. At any one time during the cycle, one or more compression chambers 80 are at different stages in the compression cycle. During a cycle of the compressor 10, the refrigerant is transported towards the center of the compression chambers 80.

Returning to FIG. 1, the front cover 28 forms a discharge volume 82. The discharge volume 82 is in communication with the refrigerant output port. Pressurized refrigerant leaves the compression device 18 through one or more orifices (not shown). The release of pressurized refrigerant is controlled by a reed mechanism 86.

Scroll Backpressure System

In one aspect of the present invention, the electric compressor 10 may include a scroll backpressure system 200. The scroll backpressure system 200 may be provided in a compressor 10 configured to utilize a refrigerant such as refrigerant grade CO2 (R744). However, it should be noted that the present invention is not limited to a compressor using a specific refrigerant.

In the embodiment(s) disclosed above, the housing or outer housing 12 includes a center housing 24 and the compression device 18 includes a thrust body 130. In the illustrated embodiment, the center housing 24 and the thrust body 130 form part of a compression device body 202. The scroll backpressure system 200 may be located at least partially, within the compression device body 202. As will be discussed in more detail below, the scroll backpressure system 200 controllably manages or adjusts backpressure, i.e., pressure of refrigerant within a backpressure pocket 204 (see below) relative to suction pressure within the intake volume 74 to overcome the axial separation of the fixed scroll 26 and the orbiting scroll 66 while not applying too much pressure resulting in excess friction between the scrolls 26, 66. The backpressure pocket 204 is internal to the compression device 18 adjacent a side of the orbiting scroll 66 such that pressurized refrigerant within the backpressure pocket 204 exerts force against the orbiting scroll 66 in the direction of the fixed scroll 26.

The pressure of refrigerant within the intake volume 74 may be referred to as suction pressure. The pressure of refrigerant with the discharge volume 82 may be referred to as discharge pressure. The pressure of refrigerant with the backpressure pocket 204 may be referred to as backpressure.

As will be discussed in more detail below, in one aspect of the present invention, the backpressure system 200 includes a first pressure pathway 206 and a second pressure pathway 208. The first pressure pathway 206 is located between the discharge volume 82 and the back pressure pocket 204 and is configured to allow pressurized refrigerant in the discharge volume 82 to be introduced into the backpressure pocket 204. The first pressure pathway 206 is formed, at least partially, in the compression device body 202. The second pressure pathway 208 is located between the backpressure pocket 204 and the intake volume 74. The second pressure pathway 208 may include a dump valve 210 (see below) for controllably bleeding off pressured refrigerant in the backpressure pocket 204 into the intake volume 74.

Figure 2:
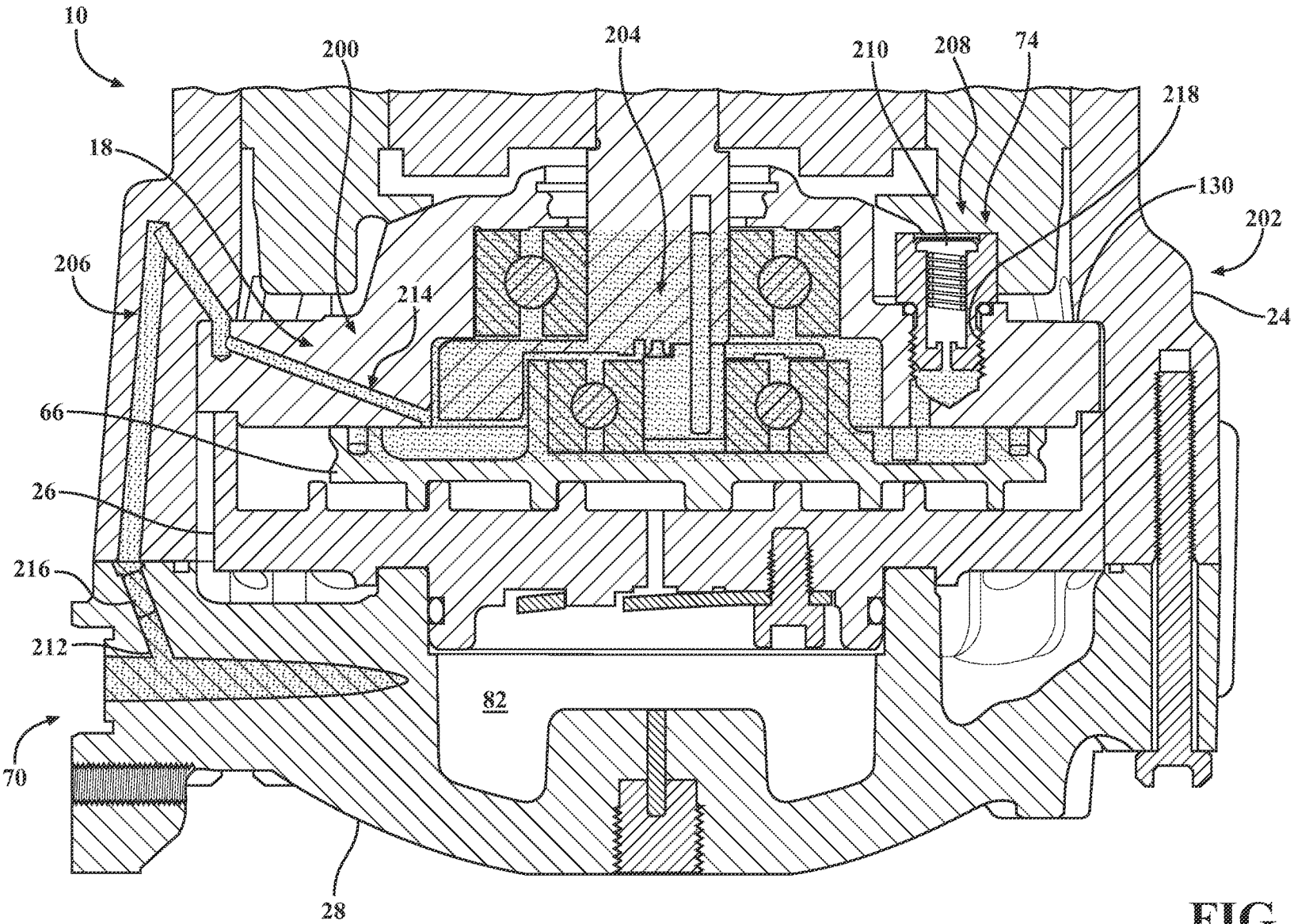
FIG. 2 a partial cross-section view of the electric compressor of FIG. 1, including a scroll backpressure system according to a first embodiment.

With specific reference to FIG. 2, an exemplary scroll backpressure system 200 according to a first embodiment is shown. As discussed above, in the illustrated embodiment the housing 12 includes a center housing 24 and a front cover 28. As shown, the discharge volume 82 may be formed, at least partially, by the center housing 24, the front cover 28 and the refrigerant outlet port 70.

In the first embodiment, the first pressure pathway 206 includes a first pressure pathway end 212 connected to the refrigerant outlet port 70 and a second pressure pathway end 214 connected to the backpressure pocket 204. As shown, the first pressure pathway 204 may be located with, and partially integral with the center housing 24. Further, the first pressure pathway 204 may include a fixed orifice 216 to restrict flow of the pressurized refrigerant from the discharge volume to the backpressure pocket.

As discussed above, the compression device body 202 may be formed, in part, by the center housing 24 and the thrust body 130. As shown, the thrust body 130 may include a threaded aperture 218 between the intake volume 74 and the backpressure pocket 204. In the first embodiment shown in FIG. 21, the dump valve 210 may be threaded within with the threaded aperture 218. The dump valve 210 is configured to maintain a fixed pressure differential between the backpressure pocket 204 and the intake volume 74.

The backpressure pocket 204 may be formed, at least partially by the compression device body 202, and more specifically by the thrust body 130.

In the illustrated embodiment shown in FIG. 2, the dump valve 210 is spring biased to a closed position. If the pressure of the refrigerant within the backpressure pocket 204, i.e., the backpressure, exceeds a threshold, the dump valve 210 opens allowing excess refrigerant to bleed off to the intake volume 74. Once the backpressure is reduced below the threshold, the dump valve 210 closes, preventing passage of refrigerant therethrough.

In the illustrated embodiment, the first pressure pathway 206 may be formed through the front cover 28, the center housing, 24 and the thrust body 130.

With reference to FIGS. 3A-3B, 4A-4D, 5A-5B, 6, an exemplary scroll backpressure system 200 according to a second embodiment is shown. In the second embodiment, the first and second pressure pathways 206, 208 are within the compression device body 202, and more specifically, within the thrust body 130.

Figure 3A:
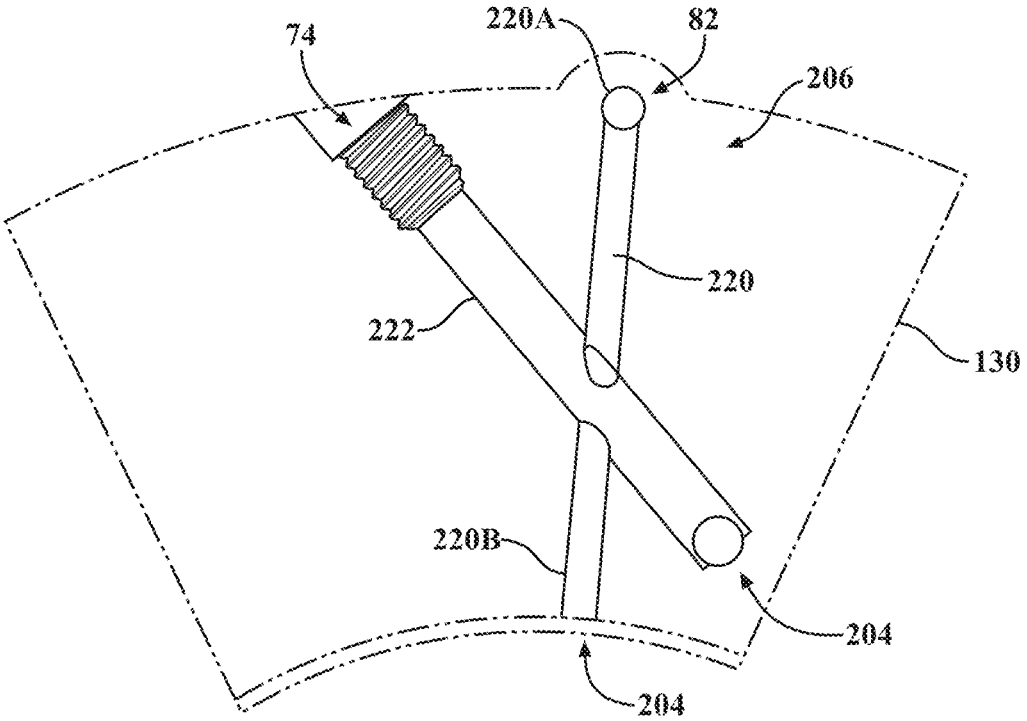
FIGS. 3A-3B are graphic depictions of a portion of an electric compressor including a scroll backpressure system, according to a second embodiment.
Figure 3B:
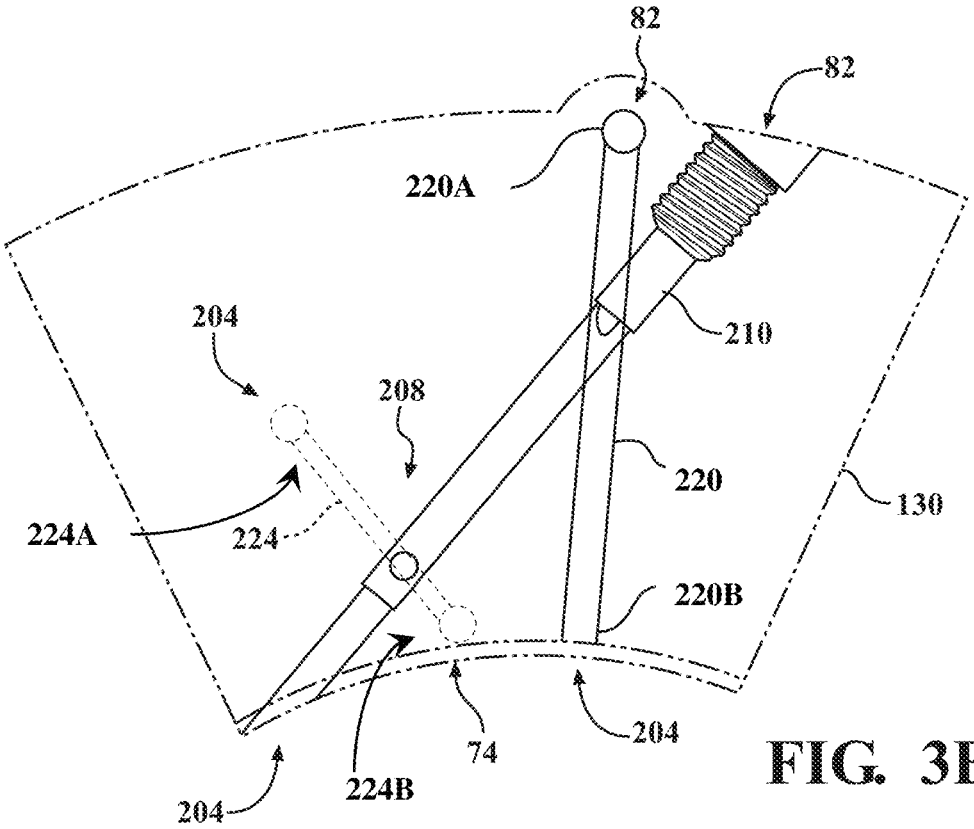

With specific reference to FIGS. 3A-3B, a graphic representation of the thrust body 130 and the first pressure pathway 206 in the second embodiment is shown. In the second embodiment, the first pressure pathway 206 includes a first pressure passage 220 and a backpressure regulator valve 222. The first pressure passage 220 is located within the thrust body 130. The first pressure passage 220 has a first end 220A open to the discharge volume 82 and a second end 220B open to the backpressure pocket 204. Flow of refrigerant between the discharge volume 82 and the backpressure pocket 204 is controlled by a backpressure regulator valve 222 as a function of the pressure differential between suction pressure in the intake volume 74 and pressure in the backpressure pocket 204 (see below).

As discussed above, the backpressure regulator valve 222 is connected between the intake volume 74 and the backpressure pocket 204. The backpressure regulator valve 222 is configured to modify flow of pressure refrigerant from the discharge volume 82 to the backpressure pocket 204 through the first passage 220 of the first pressure pathway 206 as a function of pressure differential between the intake volume 74 and the backpressure pocket 204. With specific reference to FIGS. 4A-4D, 5 and 7A, in one embodiment the backpressure regulator valve 222 may be a sliding regulator valve 226 integrated into the compression device body 202, and more particularly, into the thrust body 130. As shown, the sliding regulator valve 226 may include a valve body 226A (formed by the thrust body 130), a valve pin 226B, and a valve spring 226C.

Operation of the sliding regulator valve 226 is shown in FIGS. 4A-4D. During startup of the compressor 10, the sliding regulator valve 226 may be in a fully open position (shown in FIG. 4A) providing a direct path between the discharge volume 82 and the backpressure pocket 204. Thus, intake pressure, backpressure, and discharge pressure are equal.

Figure 4A:
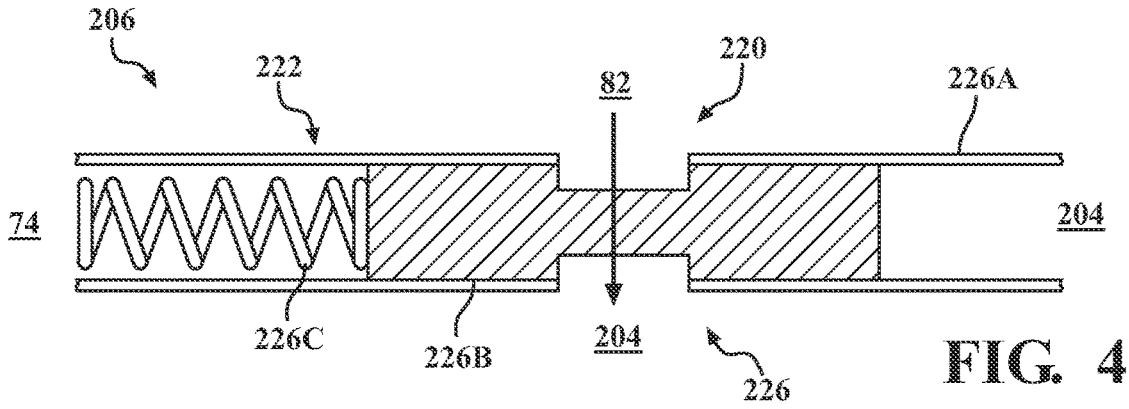
FIGS. 4A-4D are illustrations of a backpressure regulator valve of the electric compressor of FIG. 1 during operation.
Figure 4B:
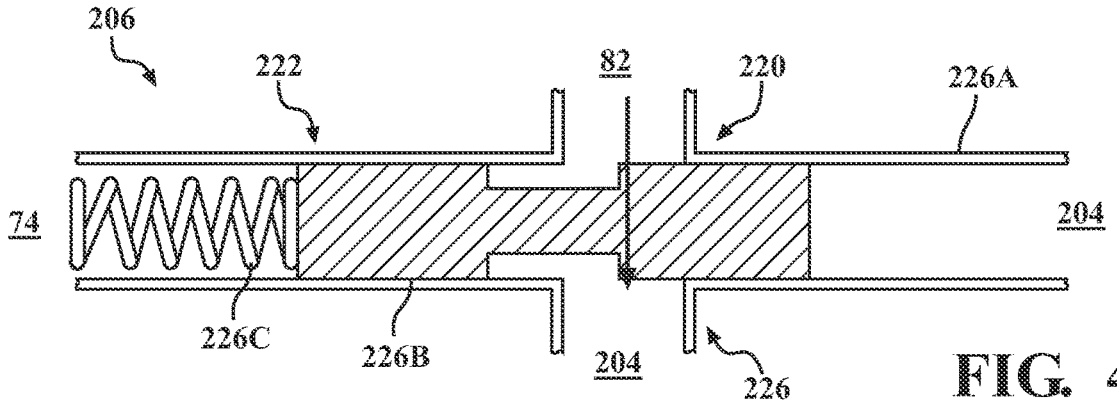

As backpressure increases, but has not yet reached a target pressure, backpressure operates on one end of the valve stem 226B compressing the spring 226C and the pin 226B moves, the discharge path between the discharge volume 82 and the backpressure pocket 204 begins to close (see FIG. 4B).

Figure 4C:
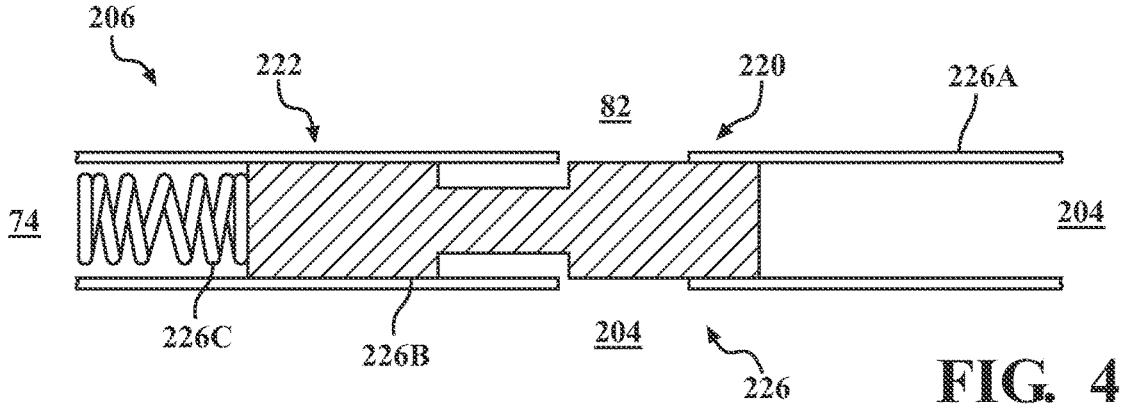

As shown in FIG. 4C, when the backpressure reaches the target pressure, the spring 226C further compresses and the pin 226B blocks discharge path between the discharge volume 82 and the backpressure pocket 204.

Figure 4D:
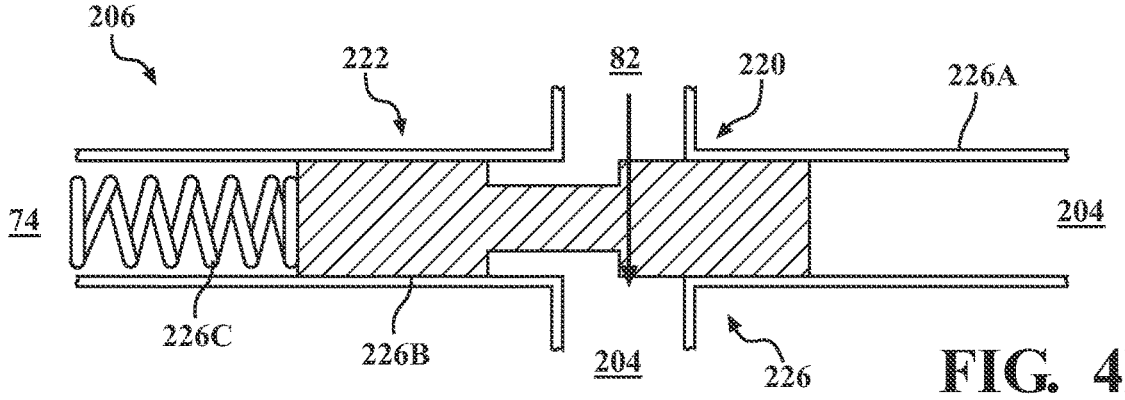

If backpressure leaks or drops below the target pressure, the valve spring 226C will move the valve pin 226B, opening the discharge path, until the target pressure is once again achieved (see FIG. 4D).

With specific reference to FIG. 3B, a graphic representation of the thrust body 130 and the second pressure pathway 208 in the second embodiment is shown. In the second embodiment, the second pressure pathway 208 includes a second pressure passage 224. The second pressure passage 224 is located within the thrust body 130. The second pressure passage 224 has a first end 224A open to the backpressure pocket 204 and a second end 224B open to the intake volume 74. Flow of refrigerant between the backpressure pocket 204 and the intake volume 74 is controlled by the dump valve 210 as a function of the pressure differential between discharge pressure in the discharge volume 82 and pressure in the backpressure pocket 204 (see below).

As discussed above, in the illustrated embodiment, the second pressure pathway 208 includes the second pressure passage 224 and the dump valve 210. The second pressure passage 224 may be located within the compression device body 202, and more particularly, within the thrust body 130 between the intake volume 74 and the backpressure pocket 204.

Figure 6:
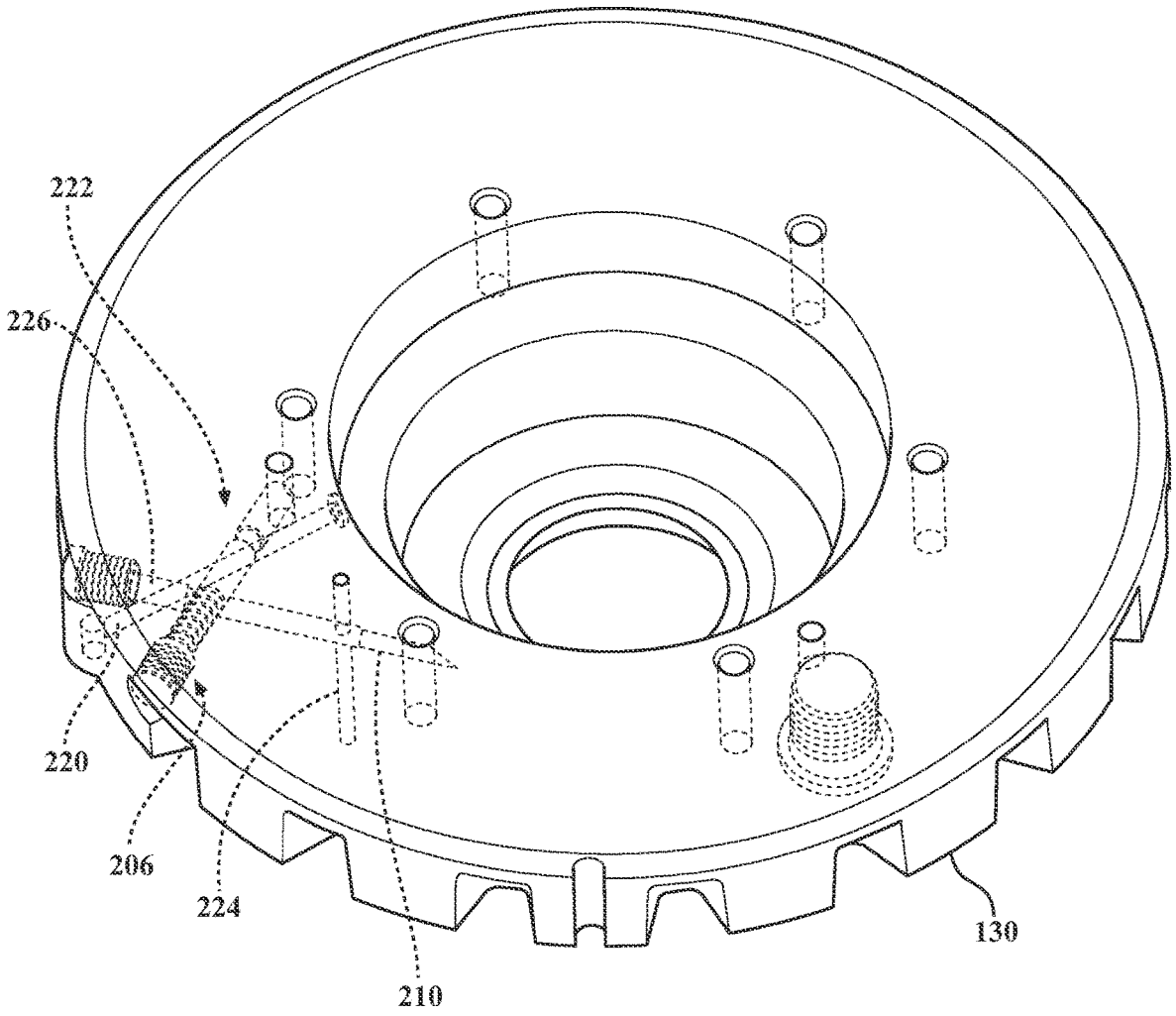
FIG. 6 is a perspective view of a thrust body of the electric compressor of FIGS. 5A-5D.

As shown in FIGS. 3B, 6 and 7B, the dump valve 210 is coupled between the discharge volume 82 and the backpressure pocket 204 to control the flow of refrigerant between the backpressure pocket 204 and the intake volume 74 as a function of pressure differential between the discharge volume 82 and the backpressure pocket 204.

With specific reference to FIGS. 5A-5B, 6 and 7B, in one embodiment the dump valve 210 may be a second sliding regulator valve 228 integrated into the compression device body 202, and more particularly, into the thrust body 130. As shown, the second sliding regulator valve 228 may include a valve body 228A (formed by the thrust body 130) and a valve pin 228B, and a valve spring 224C.

Figure 5A:
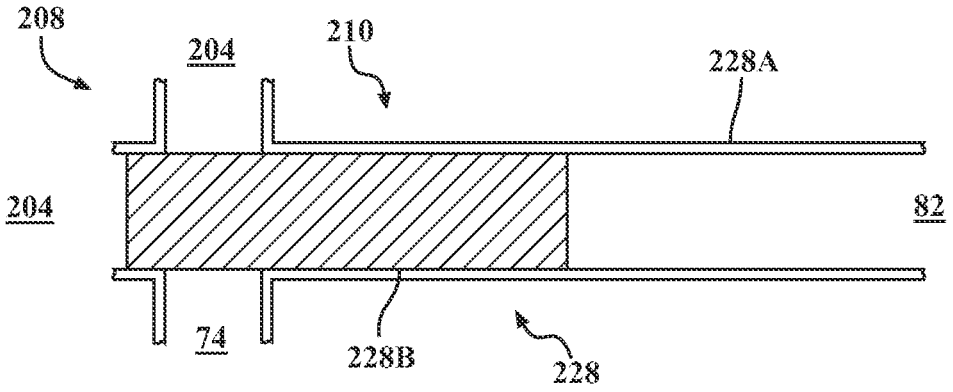
FIGS. 5A-5B are illustrations of a dump valve of the electric compressor of FIGS. 3A-3B during operation.
Figure 5B:
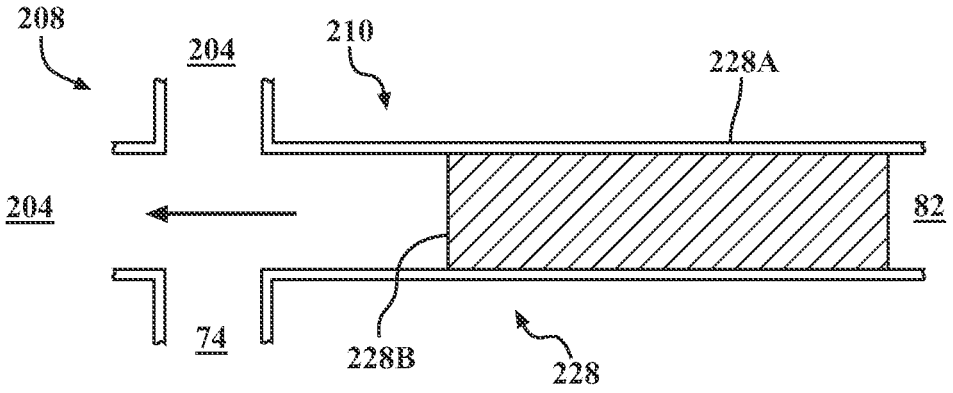

Operation of the second sliding regulator valve 228 is shown in FIGS. 5A-5B. During normal operation of the compressor 10, discharge pressure is greater than back pressure. The valve pin 228B is loaded against the back pressure and blocks venting of refrigerant from the backpressure pocket 204 to the intake volume 74 (see FIG. 5A).

When the compressor 10 is shutdown, shutdown pressure and discharge pressure equalize at a pressure less than the backpressure. The valve pin 228B is loaded towards the discharge side opening the second sliding regulator valve 228. This allows refrigerant to vent from the backpressure pocket 204 to the intake volume 74 to equalize the pressure and to prevent axial overload between the scrolls 26, 66 (see FIG. 5B).

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed:

1. An electric scroll compressor configured to compress a refrigerant, comprising:

a housing defining an intake volume and a discharge volume;

a refrigerant inlet port coupled to the housing and configured to introduce the refrigerant to the intake volume;

a refrigerant outlet port coupled to the housing and configured to allow compressed refrigerant to exit the electric scroll compressor from the discharge volume;

an inverter module mounted inside the housing and adapted to convert direct current electrical power to alternating current electrical power;

a motor mounted inside the housing;

a drive shaft coupled to the motor;

a compression device coupled to the drive shaft, for receiving the refrigerant from the intake volume and compressing the refrigerant as the drive shaft is rotated by the motor, the compression device including:

a compression device body, a fixed scroll located within the housing and being fixed relative to the compression device body; and, an orbiting scroll coupled to the drive shaft, the orbiting scroll and the fixed scroll forming compression chambers for receiving the refrigerant from the intake volume and compressing the refrigerant as the drive shaft is rotated about the center axis, the compression device forming a backpressure pocket; and, a scroll backpressure system, located at least partially, within the compression device body, the scroll backpressure system, including:

a first pressure pathway between the discharge volume and the backpressure pocket configured to allow pressurized refrigerant in the discharge volume to be introduced into the backpressure pocket, the first pressure pathway being formed, at least partially, in the compression device body, and, a second pressure pathway between the backpressure pocket and the intake volume, the second pressure pathway including a dump valve for controllably bleeding off pressured refrigerant in the backpressure pocket into the intake volume, wherein the dump valve is coupled between the discharge volume and the backpressure pocket to control the flow of refrigerant between the backpressure pocket and the intake volume as a function of pressure differential between the discharge volume and the backpressure pocket.

2. The electric scroll compressor, as set forth in claim 1, wherein the housing includes a center housing and a front cover, the discharge cavity being formed, at least partially, by the center housing, the front cover and the refrigerant outlet port.

3. The electric scroll compressor, as set forth in claim 2, the first pressure pathway having a first pressure pathway end connected to the refrigerant outlet port.

4. The electric scroll compressor, as set forth in claim 3, wherein the first pressure pathway has a second pressure pathway end connected to the backpressure pocket.

5. The electric scroll compressor, as set forth in claim 4, wherein the first pressure pathway is located with, and partially integral with the center housing.

6. The electrical scroll compressor, as set forth in claim 5, wherein the first pressure pathway includes a fixed orifice to restrict flow of the pressurized refrigerant from the discharge volume to the backpressure pocket.

7. The electric scroll compressor, as set forth in claim 6, wherein the dump valve is configured to maintain a fixed pressure differential between the backpressure pocket and the intake volume.

8. The electric scroll compressor, as set forth in claim 2, wherein the compression device body includes a thrust plate, the backpressure pocket being formed at least partially by the thrust plate, the first pressure pathway being formed through the front cover, the center housing and the thrust plate.

9. The electric scroll compressor, as set forth in claim 8, the first pressure pathway having a first pressure pathway end connected to the refrigerant outlet port.

10. The electric scroll compressor, as set forth in claim 9, wherein the first pressure pathway has a second pressure pathway end connected to the backpressure pocket.

11. The electrical scroll compressor, as set forth in claim 10, wherein the first pressure pathway includes a fixed orifice to restrict flow of the pressurized refrigerant from the discharge volume to the backpressure pocket.

12. The electric scroll compressor, as set forth in claim 11, wherein the dump valve is configured to maintain a fixed pressure differential between the backpressure pocket and the intake volume.

13. The electric scroll compressor, as set forth in claim 12, wherein the dump valve is located, at least partially, within the thrust thrust plate.

14. The electric scroll compressor, as set forth in claim 1, further comprising a back pressure regulator valve connected between the intake volume and the backpressure pocket, the back pressure regulator configured to modify flow of pressure refrigerant from the discharge volume to the backpressure pocket through the first pressure pathway as a function of pressure differential between the intake pressure and backpressure pocket.

15. The electric scroll compressor, as set forth in claim 14, wherein the second pressure pathway includes a passage and the dump valve, the passage being located within the compression device body between the intake volume and the backpressure pocket.

16. The electric scroll compressor, as set forth in claim 15, wherein the dump valve is coupled between the discharge volume and the backpressure pocket to control the flow of refrigerant between the backpressure pocket and the intake volume as a function of pressure differential between the discharge volume and the backpressure pocket.

17. The electric scroll compressor, as set forth in claim 1, wherein the compression device body includes a thrust plate, the backpressure pocket being formed at least partially by the thrust plate.

18. The electric scroll compressor, as set forth in claim 17, further comprising a back pressure regulator valve connected between the intake volume and the backpressure pocket and being located at least partially within the thrust plate, the back pressure regulator configured to modify flow of pressure refrigerant from the discharge volume to the backpressure pocket through the first pressure pathway as a function of pressure differential between the intake pressure and the backpressure pocket.

19. The electric scroll compressor, as set forth in claim 18, wherein the second pressure pathway includes a passage and the dump valve, the passage being located within the thrust plate between the intake volume and the backpressure pocket and the dump valve.

20. The electric scroll compressor, as set forth in claim 1, wherein the dump valve is a sliding regulator valve.

21. An electric scroll compressor configured to compress a refrigerant, comprising:

a housing including a center housing and a front cover and defining an intake volume and a discharge volume, the discharge volume being formed, at least partially, by the center housing the front cover;

a refrigerant inlet port coupled to the housing and configured to introduce the refrigerant to the intake volume;

a refrigerant outlet port coupled to the housing and configured to allow compressed refrigerant to exit the electric scroll compressor from the discharge volume;

an inverter module mounted inside the housing and adapted to convert direct current electrical power to alternating current electrical power;

a motor mounted inside the housing;

a drive shaft coupled to the motor;

a compression device coupled to the drive shaft, for receiving the refrigerant from the intake volume and compressing the refrigerant as the drive shaft is rotated by the motor, the compression device including:

a compression device body including a thrust plate, the backpressure pocket being formed at least partially by the thrust plate, a fixed scroll located within the housing and being fixed relative to the compression device body; and, an orbiting scroll coupled to the drive shaft, the orbiting scroll and the fixed scroll forming compression chambers for receiving the refrigerant from the intake volume and compressing the refrigerant as the drive shaft is rotated about the center axis, the compression device forming a backpressure pocket; and, a scroll backpressure system, located at least partially, within the compression device body, the scroll backpressure system, including:

a first pressure pathway between the discharge volume and the backpressure pocket configured to allow pressurized refrigerant in the discharge volume to be introduced into the backpressure pocket, the first pressure pathway being formed, at least partially, in the compression device body, the backpressure pocket being formed at least partially by the thrust plate, the first pressure pathway being formed through the front cover, the center housing and the thrust plate, wherein the first pressure pathway having a first pressure pathway end connected to the refrigerant outlet port, a second pressure pathway end connected to the backpressure pocket, and a fixed orifice to restrict flow of the pressurized refrigerant from the discharge volume to the backpressure pocket, and a second pressure pathway between the backpressure pocket and the intake volume, the second pressure pathway including a dump valve for controllably bleeding off pressured refrigerant in the backpressure pocket into the intake volume, wherein the dump valve is configured to maintain a fixed pressure differential between the backpressure pocket and the intake volume and is located, at least partially, within the thrust plate, wherein the dump valve is coupled between the discharge volume and the backpressure pocket to control the flow of refrigerant between the backpressure pocket and the intake volume as a function of pressure differential between the discharge volume and the backpressure pocket.

22. The electric scroll compressor, as set forth in claim 21, wherein the dump valve is a sliding regulator valve.

23. An electric scroll compressor configured to compress a refrigerant, comprising:

a housing defining an intake volume and a discharge volume;

a refrigerant inlet port coupled to the housing and configured to introduce the refrigerant to the intake volume;

a refrigerant outlet port coupled to the housing and configured to allow compressed refrigerant to exit the electric scroll compressor from the discharge volume;

an inverter section including:

an inverter housing, an inverter back cover connected to the inverter housing and forming an inverter cavity, an inverter module mounted inside the inverter cavity and adapted to convert direct current electrical power to alternating current electrical power;

a motor section including:

a drive shaft located within the housing, having first and second ends and defining a center axis, and a motor located within the housing to controllably rotate the drive shaft about the center axis;

a compression device coupled to the drive shaft, for receiving the refrigerant from the intake volume and compressing the refrigerant as the drive shaft is rotated by the motor, the compression device including:

a compression device body including a thrust plate, the backpressure pocket being formed at least partially by the thrust plate, a fixed scroll located within the housing and being fixed relative to the thrust plate;

an orbiting scroll coupled to the drive shaft, the orbiting scroll and the fixed scroll forming compression chambers for receiving the refrigerant from the intake volume and compressing the refrigerant as the drive shaft is rotated about the center axis; and, a scroll backpressure system, located at least partially, within the compression device body, the scroll backpressure system, including:

a first pressure pathway between the discharge volume and the backpressure pocket configured to allow pressurized refrigerant in the discharge volume to be introduced into the backpressure pocket, the first pressure pathway being formed, at least partially, in the thrust plate, a second pressure pathway between the backpressure pocket and the intake volume, the second pressure pathway including a valve for controllably bleeding off pressured refrigerant in the backpressure pocket into the intake volume, and a back pressure regulator valve connected between the intake volume and the backpressure pocket and being located at least partially within the thrust plate, the back pressure regulator valve configured to modify flow of pressure refrigerant from the discharge volume to the backpressure pocket through the first pressure pathway as a function of pressure differential between the intake pressure and the backpressure pocket, wherein the second pressure pathway includes a passage and the dump valve, the passage being located within the compression device body between the intake volume and the backpressure pocket, the dump valve is coupled between the discharge volume and the backpressure pocket to control the flow of refrigerant between the backpressure pocket and the intake volume as a function of pressure differential between the discharge volume and the backpressure pocket.

24. The electric scroll compressor, as set forth in claim 22, wherein the dump valve is a sliding regulator valve.

* * * * *